US006926482B2

(12) United States Patent
Gohlke

(10) Patent No.: US 6,926,482 B2
(45) Date of Patent: Aug. 9, 2005

(54) CONTAINER AND METHOD FOR TRANSPORTING CARGO ON A FLATBED VEHICLE

(76) Inventor: William O. Gohlke, 2498 Windsor Way Ct., Wellington, FL (US) 33414

( * ) Notice: Subject to any disclaimer, the term of this patent is extended or adjusted under 35 U.S.C. 154(b) by 431 days.

(21) Appl. No.: 10/092,534

(22) Filed: Mar. 8, 2002

(65) Prior Publication Data

US 2003/0170111 A1 Sep. 11, 2003

(51) Int. Cl.[7] ..... B60P 7/08
(52) U.S. Cl. ..... 410/91; 410/89; 410/90
(58) Field of Search ..... 410/89, 90, 91; 296/35.3; 220/1.5, 1.6, 495.06, 810, 826

(56) References Cited

U.S. PATENT DOCUMENTS

| | | | | | |
|---|---|---|---|---|---|
| 2,030,862 | A | * | 2/1936 | Fitch | 410/71 |
| 2,457,841 | A | | 1/1949 | Smith et al. | |
| 2,666,552 | A | | 1/1954 | Coit, Jr. | |
| 2,667,319 | A | | 1/1954 | Coit, Jr. | |
| 2,738,940 | A | | 3/1956 | Coit, Jr. | |
| 2,892,562 | A | | 6/1959 | Smithson | |
| 2,898,122 | A | | 8/1959 | Beckner | |
| 3,116,702 | A | * | 1/1964 | Stough | 410/89 |
| 3,259,400 | A | * | 7/1966 | Tantlinger et al. | 410/81 |
| 3,372,829 | A | | 3/1968 | Averill | |
| 3,508,764 | A | * | 4/1970 | Dobson et al. | 410/90 |
| 3,680,491 | A | * | 8/1972 | Chapman et al. | 410/89 |
| 3,762,593 | A | | 10/1973 | Beretta | |
| 3,866,787 | A | | 2/1975 | Allegri et al. | |
| 3,917,103 | A | | 11/1975 | Beretta | |
| 3,935,958 | A | | 2/1976 | Frangos | |
| 3,979,006 | A | | 9/1976 | Jurasek | |
| 3,981,410 | A | | 9/1976 | Schurch | |
| 4,015,743 | A | | 4/1977 | Beretta | |
| 4,106,626 | A | | 8/1978 | Trubiano | |
| 4,150,762 | A | | 4/1979 | Brunette | |
| 4,173,289 | A | | 11/1979 | Nesti | |
| 4,478,155 | A | * | 10/1984 | Cena et al. | |
| 4,662,532 | A | | 5/1987 | Anderson et al. | |
| 5,361,923 | A | | 11/1994 | Knight, IV et al. | |
| 5,609,451 | A | * | 3/1997 | McCorkle, Jr. | 410/90 |
| 5,746,341 | A | | 5/1998 | Olson | |
| 6,164,476 | A | | 12/2000 | Rene et al. | |
| 6,499,783 | B1 | * | 12/2002 | Husted | |
| 6,503,036 | B1 | * | 1/2003 | Bequette et al. | 410/94 |

* cited by examiner

*Primary Examiner*—Stephen Gordon
(74) *Attorney, Agent, or Firm*—Manelli Denison & Selter; Edward J. Stemberger

(57) ABSTRACT

A container is provided for transporting cargo on a flatbed vehicle. The container includes a top wall structure; a bottom wall structure opposing the top wall structure; a front wall structure; a rear wall structure opposing the front wall structure; and a pair of sidewall structures disposed in opposing relation. The top wall structure, the bottom wall structure, the front wall structure, the rear wall structure and the sidewall structures are coupled so as to form an enclosed interior space. The bottom wall structure has leg structures extending therefrom. The leg structures are spaced a sufficient length and are constructed and arranged to be received in recesses defined at opposing sides of a cargo carrying surface of the flatbed vehicle to mount the container with respect to the cargo carrying surface. Certain of the wall structures are constructed and arranged to be opened and closed to place and store cargo in the interior space.

18 Claims, 6 Drawing Sheets

CONTAINER AND METHOD FOR TRANSPORTING CARGO ON A FLATBED VEHICLE

FIELD OF THE INVENTION

The invention relates to shipping containers and, more particularly, to containers, for transporting cargo such as vehicle tires, configured to be carried by a flatbed vehicle.

BACKGROUND OF THE INVENTION

Transporting vehicle tires to tire dealers is time consuming and expensive. For example, tires are typically collected from a warehouse and rolled into a trailer of a truck by three or more workers. The tires are then stacked, nested or arranged in other manners to maximize the number of tires received on the trailer. After being transported to a tire dealer, the tires are removed manually from the truck while the truck remains at the dealer. Typically, due to the time required to collect the tires, load and unload the truck, the truck can be used only once during a 24 hour period.

Accordingly, there is a need to provide a container for shipping tires or other cargo that can be transported on a flatbed vehicle and then be left at a location for unloading.

SUMMARY OF THE INVENTION

An object of the invention is to fulfill the need referred to above. In accordance with the principles of the present invention, this objective is achieved by providing a container for transporting cargo on a flatbed vehicle. The container includes a top wall structure; a bottom wall structure opposing the top wall structure; a front wall structure; a rear wall structure opposing the front wall structure; and a pair of sidewall structures disposed in opposing relation. The top wall structure, the bottom wall structure, the front wall structure, the rear wall structure and the sidewall structures are coupled so as to form an enclosed interior space. The bottom wall structure has leg structures extending therefrom. The leg structures are spaced a sufficient length and are constructed and arranged to be received in recesses defined at opposing sides of a cargo carrying surface of the flatbed vehicle to mount the container with respect to the cargo carrying surface. Certain of the wall structures are constructed and arranged to be opened and closed to place and store cargo in the interior space.

In accordance with another aspect of the invention, a container for transporting cargo on a flatbed vehicle includes a top wall structure; a bottom wall structure opposing the top wall structure, the bottom wall structure being generally rectangular and having four corners; a front wall structure; a rear wall structure opposing the front wall structure; and a pair of sidewall structures disposed in opposing relation. The top wall structure, the bottom wall structure, the front wall structure, the rear wall structure and the sidewall structures are coupled so as to form a generally rectangular enclosed interior space. The bottom wall structure has fork-receiving structure extending therefrom. The fork-receiving structure is constructed and arranged to receive forks of a forklift to move the container and, to support the container when the container is resting on a surface. The top wall structure and the front wall structure is constructed and arranged to be opened and closed to place and store cargo in the interior space.

Another aspect of the invention relates to a method of transporting cargo on a flatbed vehicle. A container has a top wall structure; a bottom wall structure opposing the top wall structure, the bottom wall structure having legs extending therefrom generally adjacent to the sidewall structures, a front wall structure; a rear wall structure opposing the front wall structure; and a pair of sidewall structures disposed in opposing relation. The top wall structure, the bottom wall structure, the front wall structure, the rear wall structure and the sidewall structures are coupled so as to form an interior space. At least one of the front wall structure and the top wall structure is opened and cargo is loaded into the interior space. The opened wall structure is then closed. The container is moved to the flatbed vehicle. The flatbed vehicle has a cargo carrying surface with opposing sides of the cargo carrying surface defining recesses. The legs are inserted into the recesses to mount the container to the flatbed vehicle.

Yet another aspect of the invention provides a method of delivering tires to a tire dealer. The method provides a container having a top wall structure; a bottom wall structure opposing the top wall structure, a front wall structure; a rear wall structure opposing the front wall structure; and a pair of sidewall structures disposed in opposing relation, the top wall structure, the bottom wall structure, the front wall structure, the rear wall structure and the sidewall structures being coupled so as to form an interior space. At least one of the front wall structure and the top wall structure is opened and tires are loaded into the interior space. The opened wall structure is then close and the container is moved to and secured to a flatbed vehicle. The container is then transporting to a tire dealer. At the tire dealer, the container is removed from the flatbed vehicle and left at the tire dealer for unloading.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE PREFERRED EMBODIMENT

Figure 1:
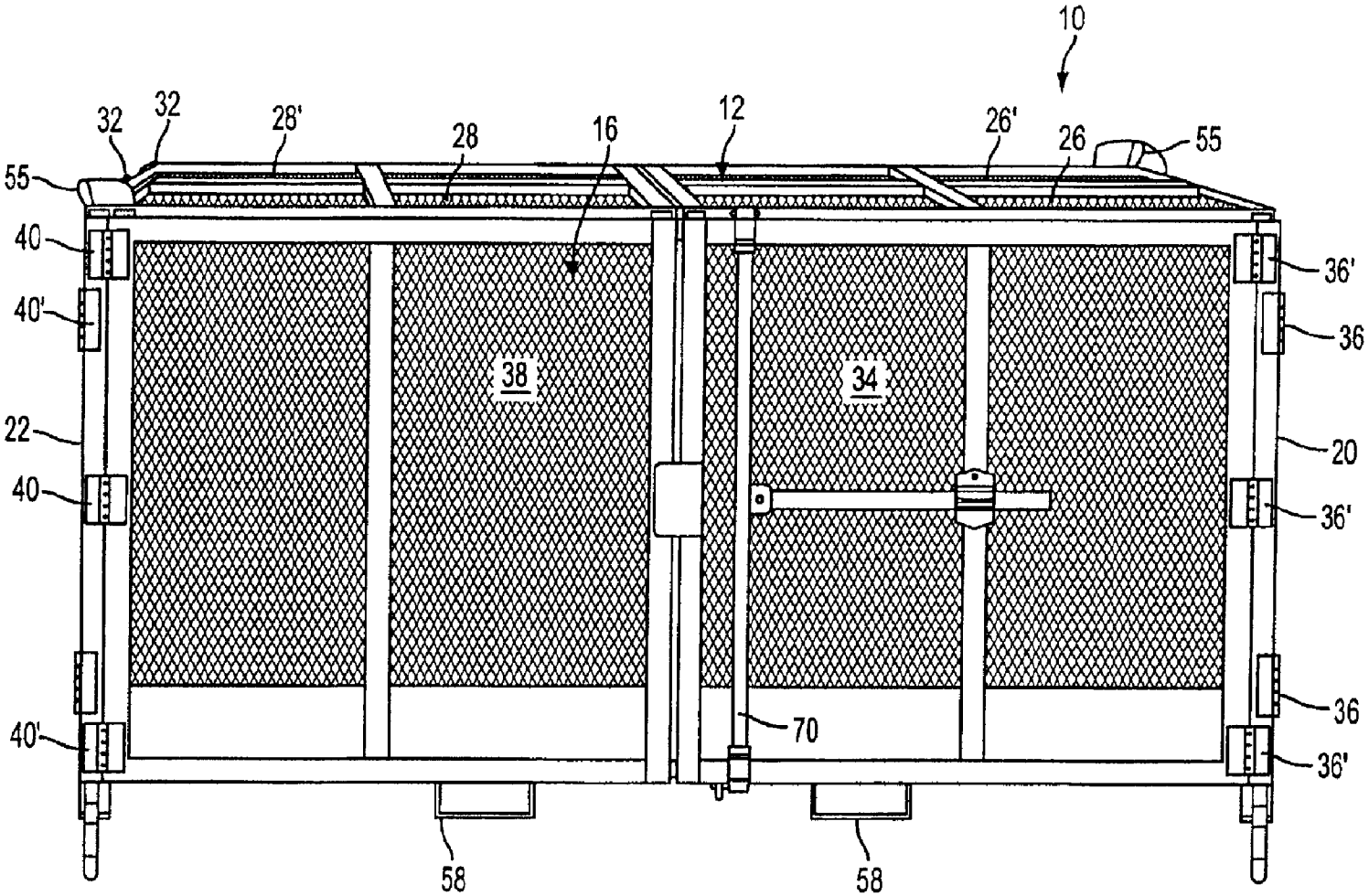
FIG. 1 is a front view of a container for transporting cargo on a flatbed vehicle provided in accordance with the principles of the present invention.
Figure 2:
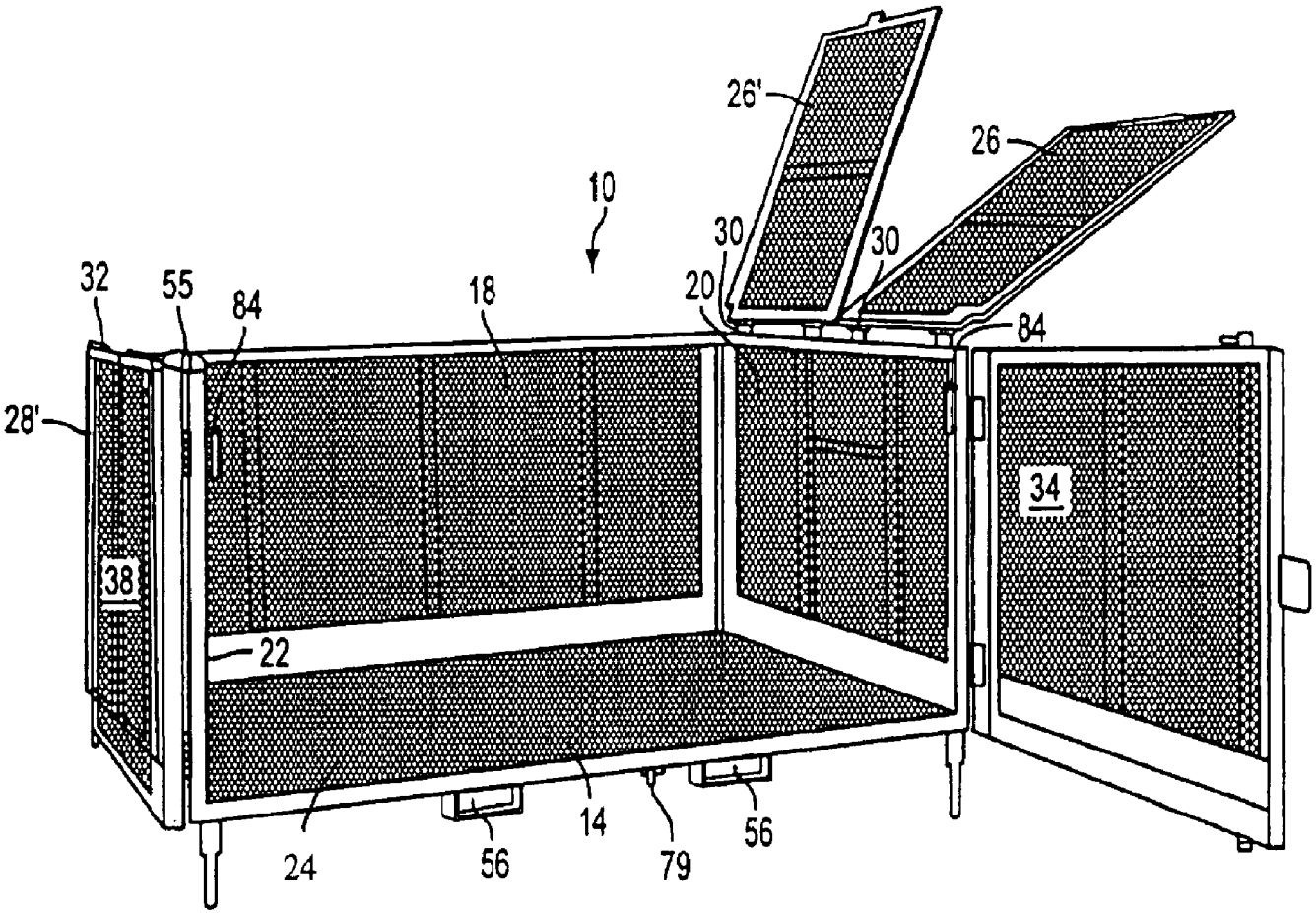
FIG. 2 is a front perspective view of the container of FIG. 1 shown with the left side of the top wall structure and front wall structure in fully open positions, with right side of the top wall structure and front wall structure in partially opened positions.

With reference to FIG. 1, a preferred embodiment of a cargo container is shown generally indicated at 10. The container 10 includes a top wall structure, generally indicated at 12, a bottom wall structure 14 opposing the top wall structure, a front wall structure, generally indicated at 16, a rear wall structure 18 opposing the front wall structure, and a pair of sidewall structures 20 and 22 disposed in opposing relation. The top wall structure 12, the bottom wall structure 14, the front wall structure 16, the rear wall structure 18 and the sidewall structures 20 and 22 being coupled so as to form an enclosed interior space 24 (FIG. 2). In the illustrated embodiment, each of the wall structures is composed of metal and is of rectangular configuration with a height of about 48 inches, a length of about 96 inches and a depth of about 70 inches.

As best shown in FIG. 2, the top wall structure 12 includes at least one first top panel 26 and at least one second top panel 28. In the illustrated embodiment, two first top panels 26 and 26' and two second top panels 28 and 28' are provide for ease of lifting and opening the top wall structure 12 by a single worker. Each of the first top panels 26 and 26' is coupled to the sidewall structure 20 via a hinge connection 30 and each of the second top panels 28 and 28' is coupled to the sidewall 22 via a hinge connection 32. Hence to obtain a fully opened position of the top wall structure, each first top panel 26 and 26' is constructed and arranged to move about the hinge connection 30 thereof to be generally adjacent to the sidewall structure 20 and each second top panel 28 and 28' is constructed and arranged to move about the hinge connection 32 thereof to be generally adjacent to the sidewall structure 22.

The front wall structure 16 includes a first front panel 34 coupled to sidewall structure 20 via a double acting hinge connection 36, 36' and a second front panel 38 coupled to sidewall structure 22 via a double acting hinge connection 40, 40'. Hence to obtain a fully opened position of the front wall structure 16, the first front panel 34 is constructed and arranged to move about the hinge connection 36 thereof to be generally adjacent to the sidewall structure 20 and the second front panel 38 is constructed and arranged to move about the hinge connection 40 thereof to be generally adjacent to the sidewall structure 22. If the top panels 26, 26' and 28, 28' are to be opened also, each top panel 26, 26' and 28, 28' is first moved to be adjacent a respective sidewall, as discussed above, and then each front panel 34 and 38 is moved to be adjacent a corresponding top panel 26, 26' and 28, 28' at a respective sidewall.

Figure 3:
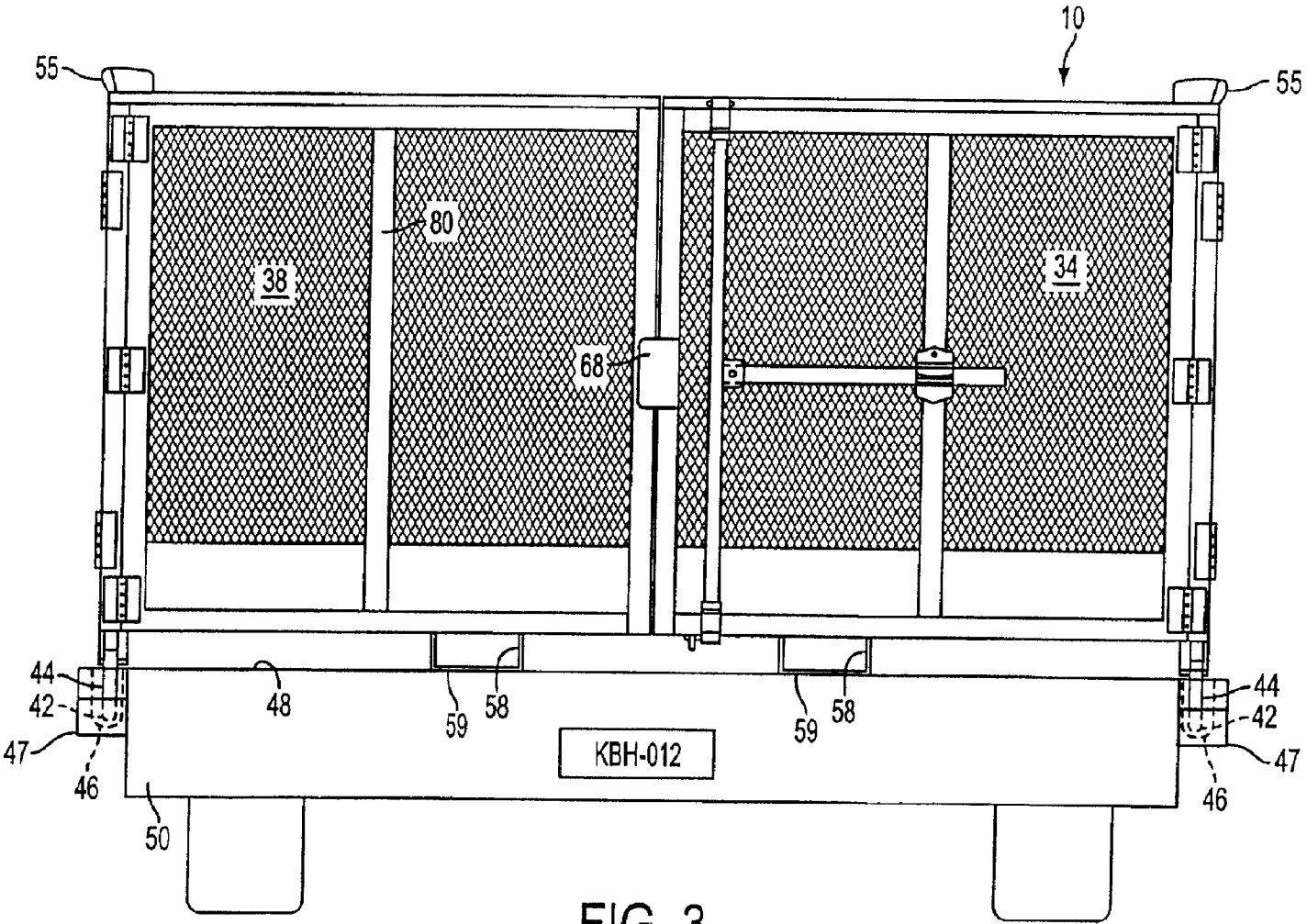
FIG. 3 is an end view of a flatbed vehicle carrying the container of FIG. 1, with the front portion of the container being shown.

In the illustrated embodiment, the bottom wall structure 14 has leg structures extending therefrom. In the illustrated embodiment, the leg structures are legs 42 extending from each corner of the bottom wall structure 14. Each leg 42 includes surfaces defining a stop 44, the function of which will be explained below. As shown in FIG. 3, legs 42 are constructed and arranged to be received in recesses 46 defined at opposing sides of a cargo carrying surface 48 of a flatbed vehicle 50. Each of the opposing sides of a conventional cargo carrying surface 48 of the flatbed vehicle includes rail structure 47 coupled thereto, defining the recesses 46. The legs 42 thus are spaced approximately 94 inches apart to corresponded with the location of the spaced recesses on a 96 inch wide flatbed vehicle. It can be appreciated that the container can be sized and the legs can be spaced to be received in recesses of flatbed vehicle of any width.

Figure 4:
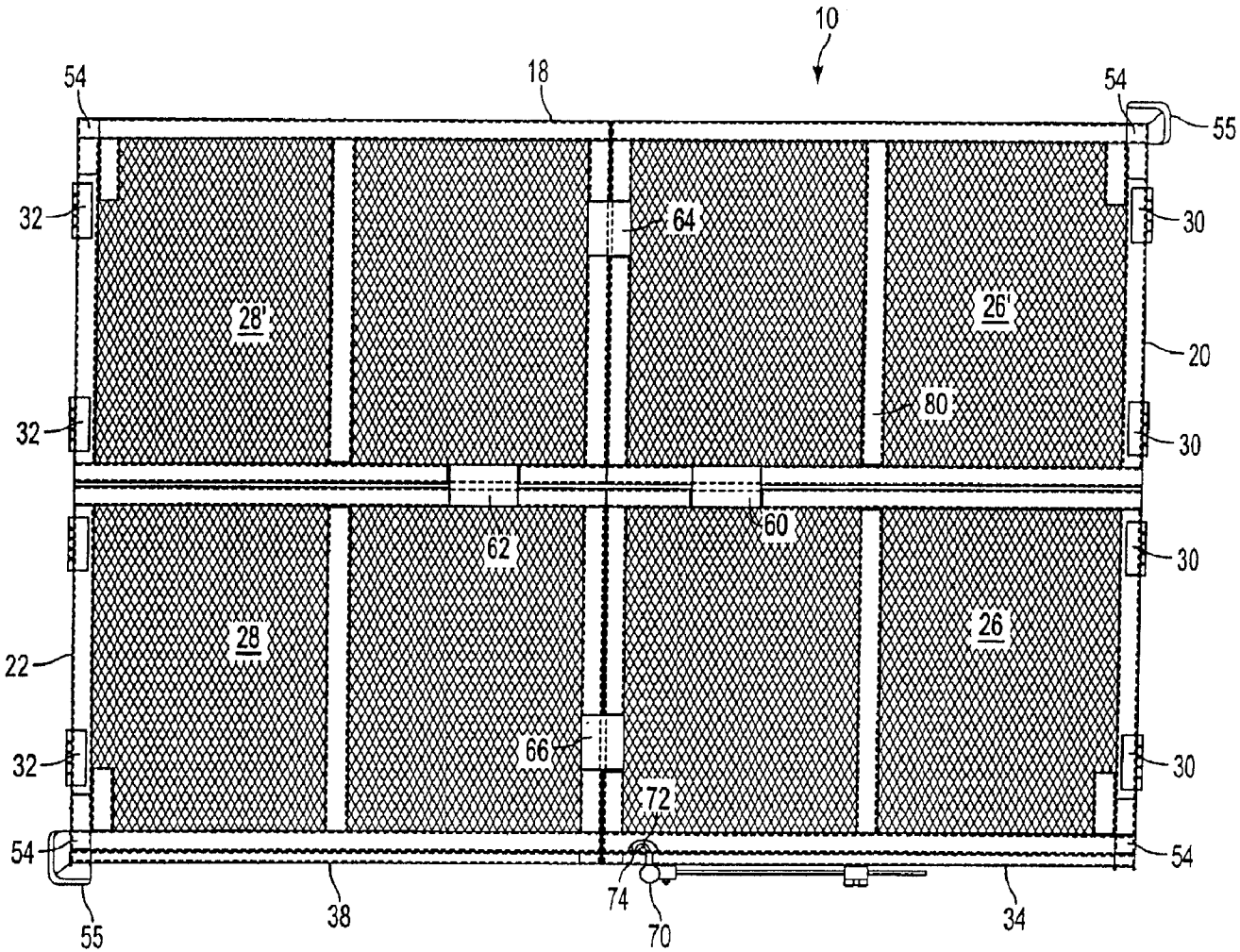
FIG. 4 is a top view of the container of FIG. 1.

In addition, the container 10 includes recesses 54 in the top thereof at each corner so that legs 42 of one container can be inserted into the recesses 54 permitting containers to be stacked vertically. With reference to FIGS. 3 and 4, to aid in the positioning of the legs 42 into the recesses 54 while stacking container, guides 55 are associated with at least two corners of the container, along the diagonal. The guides 55 act like funnels to receive a leg 42 and guide the leg 42 into the recess 54 when placing the top container in stacked relation with respect to a lower container. The stops 44 function to limit the extent to which the legs enter the recess 54.

Instead of stacking containers, a single container can be sized to have a height generally equal to the height of two stacked containers, e.g. about 95 inches. Such a height would permit a worker to walk directly into the container via opened front wall structures. Thus, there would be no need to permit the top wall structures to open.

The bottom wall structure 14 includes fork-receiving structure defining at least one pair of slots 56 constructed and arranged to receive forks of a conventional forklift. In the embodiment, fork-receiving structure includes a pair of generally U-shaped members 58 coupled to and extending from the bottom wall structure. The U-shaped members 58 are in spaced relation. Preferably, the fork-receiving structure is provided on each side of the bottom wall structure 14 for access from all sides of the container by a forklift.

As shown in FIG. 3, the stops 44 control an extent to which the legs 42 are received in the recesses 46, but the stops 44 are configured to ensure that the planar underside 59 of each of the U-shaped members 58 contacts the upper surface 48 when the container 10 is carried by the flatbed vehicle 50 (FIG. 3).

In the illustrated embodiment, since the legs 42 are secured in the recesses 44 defined by the rail structure 47 of the flatbed vehicle 50, fewer tie-downs are required to secure the container 10 to the vehicle 50. It is within the contemplation of the invention to provide the legs 42 so as not to extend beyond surface 59 of the U-shaped members or to provide no legs at all. In this embodiment (not shown), the surface 58 of each of the U-shaped members 58 will rest on surface 48 of the flatbed vehicle 50, and appropriate tie-downs can be used to secure the container to the vehicle 50.

Figure 5:
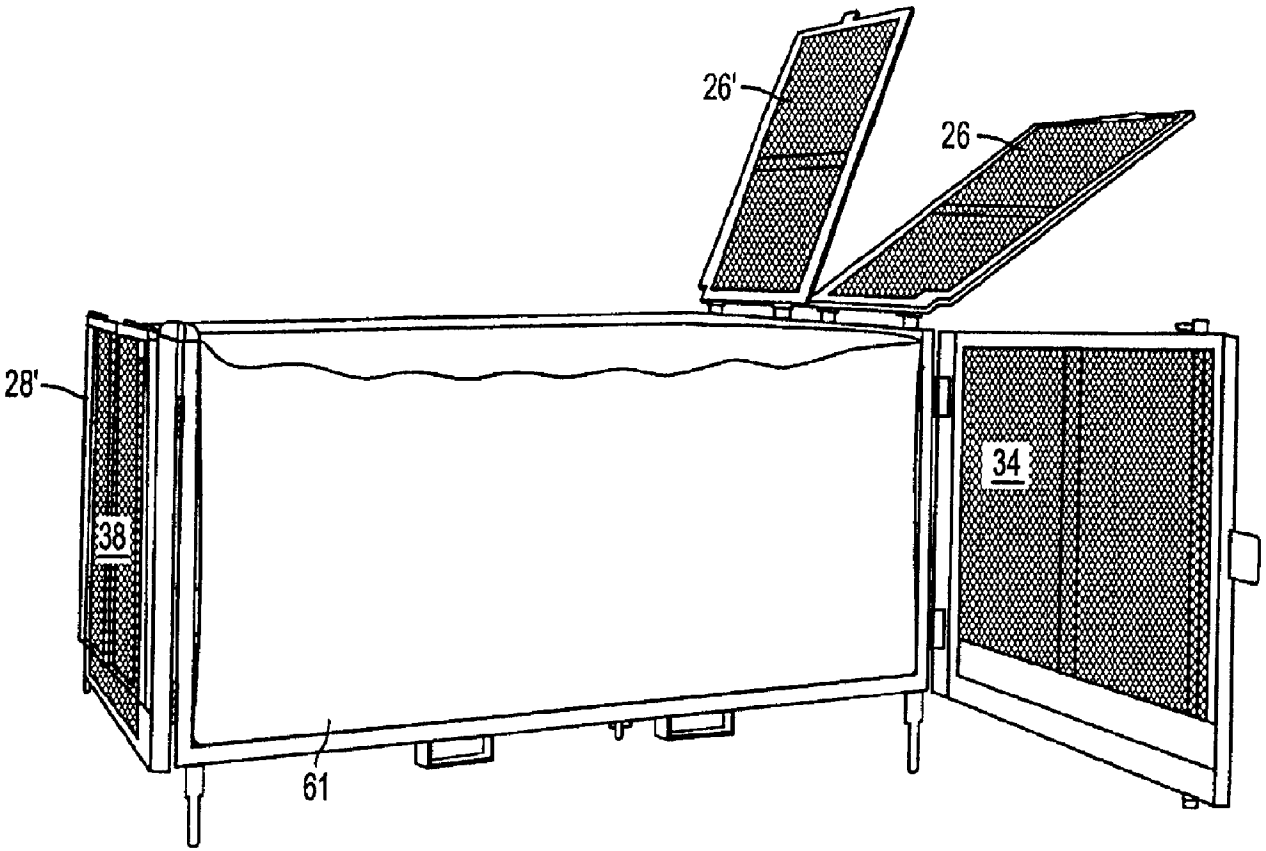
FIG. 5 is a view of a cover provided in the container of FIG. 2.

To ensure that the cargo is kept clean and dry, a cover 61, as shown in FIG. 5 is provided. The cover 61 is constructed and arranged to be disposed inside the container 10, with the cargo being loaded within the cover 61. The cover 61 has a plurality of closable flaps that can be secured to each other by Velcro® or other fastening devices. The cover 61 is preferably composed of light-weight, water-resistant material, such as Tyvek® manufactured by DuPont, or other tarp material.

Figure 2A:
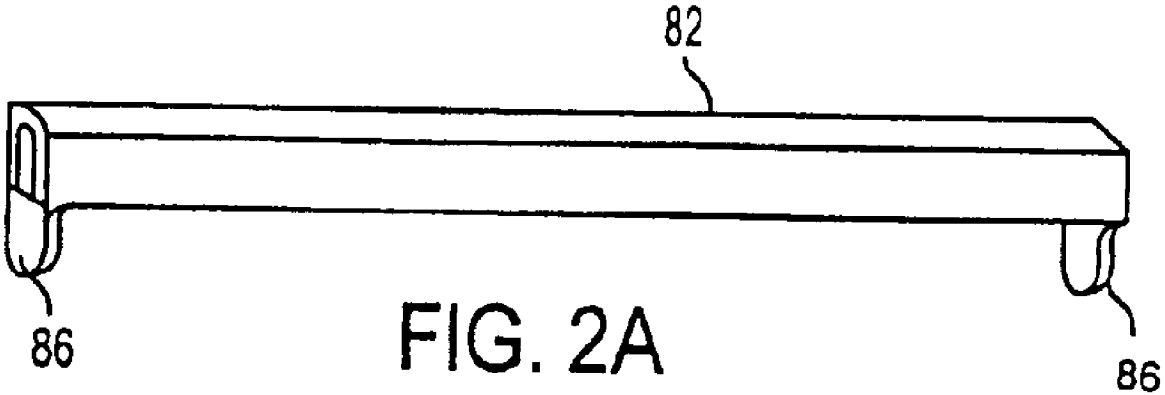
FIG. 2A is a view of a supporting structure of the container of FIG. 1.

Preferably, the wall structures or panels of container 10 have a metal frame composed of hollow bar stock with metal mesh walls coupled thereto so as to reduce the weight of the structure. To provide additional rigidity to the container 10, the wall structures can include supporting bars 80. The supporting bars 80 are preferably fixed with respect to the wall structure to which it is adding rigidity. Furthermore, removable supporting structures 82 (FIG. 2A) is provided to add rigidity to the container. With reference to FIG. 2, a pair of spaced channels 84 are provided at the front of the container 10. If desired, another pair of spaced channels 84 can be provided near the center of the container. Each supporting structure 82 includes an extending member 86 that is received in an associated channel 84 so that the supporting member extends between the sidewall structures 20 and 22. Thus, the supporting structures 82 are removably mounted to the sidewall structures 20 and 22 so as to not obstruct the interior of the container when loading the container 10.

The container 10 is useful in transporting cargo, particularly vehicle tires. Thus, the top wall structure 12 and the front wall structure 16 can be opened and tires can be stacked or nested in the interior space of the container 10. The front and top wall structures can then be closed and locked. The width of the container is such that it can be used in aisles of in a tire warehouse. Thus, a forklift can be used to move the container in a tire warehouse to the location where desired tires are loaded into the container.

With regard to locking the container 10, with reference to FIG. 4, to prevent opening of the first top panels 26, 26', a plate 60 is welded to a top edge of front top panel 26 so as to extend over a top edge of the rear top panel 26'. Similarly, to prevent opening of the second top panels 28, 28', a plate 62 is welded to a top edge of rear top panel 28' so as to extend over a top edge of the front top panel 28. Furthermore, to prevent relative movement between the rear top panels 26' and 28', a plate 64 is welded to a top edge of rear top panel 26' so as to extend over a top edge of the rear top panel 28'. To prevent relative movement between the front top panels 26 and 28, a plate 66 is welded to a front edge of front top panel 26 so as to extend over a front edge of the front top panel 28. With regard to locking the front panels 34 and 38, as shown in FIG. 3, a plate 68 is welded to a front edge of front panel 34 so as to extend over an edge of the front panel 38. A movable locking mechanism 70 secured to the front panel 34 includes a lock 72 (FIG. 4) that can be received in a recess 74 in the edge of top panel 26. A lower portion of the locking mechanism 70 is co-operable with a member 79 to secure the lower portion of the front wall structures. Thus, once the lock 70 is moved into the recess 74 with the lower portion of the locking mechanism 70 engaged with member 79, the front panels 34 and 38 and all of the top panels 26, 26', 28 and 28' are in a closed, locked condition. Hence the plates and the locking mechanism define locking structure of the container 10.

Once loaded and locked, the container 10 can then be moved to a flatbed vehicle and lifted via a forklift over the cargo carry surface 48. The legs 42 of the container 10 can then be inserted into the recesses 46 on the flatbed vehicle. If desired, two containers can be stacked vertically on the flatbed vehicle 50 with the aid of the guides 55. Tie-down straps can be used to further secure the container(s) to the flatbed vehicle. The flatbed vehicle can also carry the forklift. With this system, only one worker is needed to load and deliver the tires. The worker can transport a container to a tire dealer, leave the container for unloading, and continue on to the next dealer to deliver another container. The container(s) left at the dealers can be picked-up at a later time. With the method of the invention the flatbed vehicle can be used 24 hours a day, for example, to deliver tires to a number of tire dealers.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A container for transporting cargo on a flatbed vehicle, the container comprising:

a top wall structure, a bottom wall structure opposing the top wall structure, a front wall structure, a rear wall structure opposing the front wall structure, and a pair of sidewall structures disposed in opposing relation, the top wall structure, the bottom wall structure, the front wall structure, the rear wall structure and the sidewall structures being coupled so as to form an enclosed interior space, the bottom wall structure having leg structures extending therefrom, the leg structures being spaced a sufficient length and being constructed and arranged to be received in recesses defined at opposing sides of a cargo carrying surface of the flatbed vehicle to mount the container with respect to the cargo carrying surface, certain of said wall structures being constructed and arranged to be opened and closed to access the interior space, the container being in combination with the flatbed vehicle, the flatbed vehicle including the cargo carrying surface and the recesses defined at the opposing sides of the cargo carrying surface, wherein the bottom wall structure includes fork-receiving structure defining at least one pair of slots constructed and arranged to receive forks of a forklift, the fork receiving structure including a pair of generally U-shaped members coupled to and extending from the bottom wall structure, the U-shaped members being in spaced relation and having a planar underside surface, wherein the fork receiving structure is constructed and arranged so that the planar underside surface of the U-shaped members contacts the cargo carrying surface when the container is carried by the flatbed vehicle.

2. The container of claim 1, wherein the bottom wall structure is generally rectangular with the leg structures including a leg extending from each corner of the bottom wall structure, each leg defining stops to control an extent to which the legs are received in the recesses.

3. The container of claim 1, wherein said certain wall structures include the front wall structure.

4. The container of claim 3, further including locking structure constructed and arranged to lock in a closed condition, at least the front wall structure.

5. The container of claim 1, wherein the top wall structure includes at least a first top panel pivotally coupled to one of the sidewall structures and at least a second top panel pivotally coupled to the other sidewall structure such that the entire top wall structure can be opened to access the interior space when the first and second top panels are pivoted with respect to their respective sidewall structure.

6. The container of claim 5, wherein each of the first and second top panels is coupled to a respective one of said sidewall structures via a hinge connection, whereby to obtain a fully opened position of the top wall structure, the first top panel is constructed and arranged to move about the hinge connection thereof to be generally adjacent to the one sidewall structure and the second top panel is constructed and arranged to move about the hinge connection thereof to be generally adjacent to the other sidewall structure.

7. The container of claim 6, wherein a pair of first top panels and a pair of second top panels are provided.

8. The container of claim 1, wherein the front wall structure includes a first front panel pivotally coupled to one of the sidewall structures and a second front panel pivotally coupled to the other sidewall structure such that the entire front wall structure can be opened to access the interior space when the first and second front panels are pivoted with respect to their respective sidewall structure.

9. The container of claim 8, wherein each of the first and second front panels is coupled to a respective one of said sidewall structures via a double acting hinge connection.

10. The container of claim 6, wherein the front wall structure includes a first front panel coupled to one said sidewall structure via a double acting hinge connection and a second front panel coupled to the other sidewall structure via a double acting hinge connection, whereby when the top wall structure is in the fully opened position thereof, to obtain a fully opened position of the front wall structure, the first front panel is constructed and arranged to move about the double acting hinge connection thereof to be generally adjacent to the first top panel and the second front panel is constructed and arranged to move about the double acting hinge connection thereof to be generally adjacent to the second top panel.

11. The container of claim 10, wherein a pair of adjacent first top panels are provided defining a front first top panel and a rear first top panel, and pair of second top panels are provided defining a front second top panel and a rear second top panel.

12. The container of claim 11, further including locking structure constructed and arranged to permit all of the top panels and the front panels to be interlocked in a closed condition.

13. The container of claim 12, wherein the locking structure includes:

a first plate coupled to a top edge of one of the first top panels so as to extend over a top edge of the other first top panel, a second plate coupled to a top edge of one of the second top panels so as to extend over a top edge of the other second top panel, a third plate coupled to a top edge of one of the front top panels as to extend over a top edge of the other front top panel, a fourth plate coupled to a top edge of one of the rear top panels so as to extend over a top edge of the other rear top panel, a fifth plate coupled to a front edge of a front panel so as to extend over a front edge of the other front panel, and a movable locking mechanism secured to one of the front panels including a lock constructed and arranged to be received in a recess in an edge of one of the front top panels so as to interlock all of the top panels and the front panels in the closed condition.

14. The container of claim 1, further including leg-receiving recesses in a top portion thereof constructed and arranged to receive leg structures of another said container such that said containers can be disposed in a vertically stacked arrangement.

15. The container of claim 14, further including guides operatively associated with certain of the leg-receiving recesses, the guides being constructed and arranged to aid in inserting the legs into the leg-receiving recesses when stacking containers.

16. The container of claim 1, in combination with a cover, the cover being constructed and arranged to be received in the interior space of the container so as to surround and cover cargo.

17. The container of claim 1, wherein each opposing side of the flatbed vehicle has rail structure coupled thereto defining the recesses.

18. The container of claim 1, wherein the bottom wall structure is generally rectangular defining sides of the bottom wall structure and said pair of U-shaped members is provided on each side of the bottom wall structure to provide access from all sides of the container by a forklift.

* * * * *